US009724839B2

(12) United States Patent
Bullion

(10) Patent No.: US 9,724,839 B2
(45) Date of Patent: Aug. 8, 2017

(54) DOUBLE ARBOR VERTICAL SHAPE SAW

(71) Applicant: USNR, LLC, Woodland, WA (US)

(72) Inventor: Conrad Bullion, La Center, WA (US)

(73) Assignee: USNR, LLC, Woodland, WA (US)

( * ) Notice: Subject to any disclaimer, the term of this patent is extended or adjusted under 35 U.S.C. 154(b) by 1181 days.

(21) Appl. No.: 13/804,534

(22) Filed: Mar. 14, 2013

(65) Prior Publication Data

US 2014/0238547 A1 Aug. 28, 2014

Related U.S. Application Data

(60) Provisional application No. 61/768,302, filed on Feb. 22, 2013.

(51) Int. Cl.

| | |
|---|---|
| ***B65G 37/00*** | (2006.01) |
| ***B27B 7/04*** | (2006.01) |
| ***B27B 1/00*** | (2006.01) |
| ***B27B 3/28*** | (2006.01) |
| ***B27B 7/02*** | (2006.01) |
| ***B27G 13/02*** | (2006.01) |

(52) U.S. Cl.

CPC ..... *B27B 7/04* (2013.01); *B27B 1/007* (2013.01); *B27B 3/28* (2013.01); *B27B 7/02* (2013.01); *B27G 13/02* (2013.01); *Y10T 83/741* (2015.04); *Y10T 83/778* (2015.04)

(58) Field of Classification Search

CPC ..... B65G 37/00; B65G 37/005
USPC ..... 198/624, 626.3, 782
See application file for complete search history.

(56) References Cited

U.S. PATENT DOCUMENTS

| | | | | |
|---|---|---|---|---|
| 4,078,592 A * | 3/1978 | Standal | B27B 25/02 144/114.1 |
| 4,144,782 A | 3/1979 | Lindstrom | |
| 4,373,563 A | 2/1983 | Kenyon | |
| 4,510,981 A * | 4/1985 | Biller | B27L 1/045 144/246.2 |
| 4,554,958 A * | 11/1985 | Schmidt | B27C 5/08 144/208.6 |
| 4,907,632 A | 3/1990 | Reuter | |
| 5,558,202 A * | 9/1996 | Miller | B65G 35/00 198/604 |

(Continued)

FOREIGN PATENT DOCUMENTS

| | | |
|---|---|---|
| CA | 2068217 C | 5/1991 |
| CA | 2817137 A1 | 8/2013 |
| CA | 2867997 A1 | 8/2013 |

OTHER PUBLICATIONS

Final Office Action for U.S. Appl. No. 13/921,824 mailed Apr. 6, 2015.

(Continued)

*Primary Examiner* — Douglas Hess
(74) *Attorney, Agent, or Firm* — Schwabe Williamson & Wyatt, P.C.

(57) ABSTRACT

Embodiments relate to systems, methods, and apparatuses for shape sawing wood. Specifically, embodiments include an infeed with laterally displaceable positioning rolls and a longitudinal axis between the positioning rolls. The embodiments further include a saw box with a frame and a plurality of saws coupled with a plurality of vertical arbors within the frame. In certain embodiments, the frame is operable to move laterally or rotationally with respect to a horizontal axis of rotation.

26 Claims, 8 Drawing Sheets

(56) References Cited

U.S. PATENT DOCUMENTS

| | | | | |
|---|---|---|---|---|
| 5,915,429 | A * | 6/1999 | Pelletier | B27B 1/00 144/178 |
| 5,946,995 | A | 9/1999 | Michell et al. | |
| 6,062,281 | A | 5/2000 | Dockter et al. | |
| 6,128,989 | A | 10/2000 | Jones et al. | |
| 6,189,585 | B1 | 2/2001 | Johansson | |
| 6,216,756 | B1 * | 4/2001 | Mason | B27B 31/003 144/246.2 |
| 6,368,204 | B1 * | 4/2002 | Tokoyoda | G07D 9/00 194/344 |
| 6,896,019 | B2 * | 5/2005 | Achard | B23Q 1/621 144/245.1 |
| 7,007,729 | B1 * | 3/2006 | Landers | B27B 31/00 144/215.2 |
| 7,543,615 | B2 | 6/2009 | Woodford et al. | |
| 9,168,669 | B2 * | 10/2015 | Bullion | B27G 13/02 |
| 2004/0261590 | A1 | 12/2004 | Conry | |
| 2006/0144675 | A1 | 7/2006 | Mitchell | |
| 2014/0238548 | A1 | 8/2014 | Bullion | |

OTHER PUBLICATIONS

Canadian Examiner's Report for 2,817,137 mailed Dec. 17, 2013.
Final Office Action for U.S. Appl. No. 13/921,824 mailed Mar. 13, 2014.
Canadian Examiner's Report for 2,867,997 mailed Jan. 9, 2015.
US Office Action for U.S. Appl. No. 13/921,824 mailed Nov. 14, 2014.
Office Action for U.S. Appl. No. 13/921,824 mailed Nov. 4, 2013.
Canadian Intellectual Property Office Examiner's Report, issued Aug. 22, 2013.

* cited by examiner

DOUBLE ARBOR VERTICAL SHAPE SAW

FIELD

Embodiments of the present invention relate generally to the technical field of shape sawing logs and, in particular, to systems with a laterally and rotationally moveable saw box containing dual vertical arbor saws.

BACKGROUND

When a log, cant, or similar lumber piece (collectively referred to as a log) is sawed, the logs may be of varying shapes and sizes. For example, a log may be curved. Alternatively, different logs may have different sizes. However, it is desirable to maximize the number of usable pieces of lumber that can be produced by sawing the log. To do so, it may be desirable to remove lumber slabs or boards from the log by sawing along the curvature of the log to provide boards having parallel and curved faces that follow the log curve. Doing so maximizes the boards that can be cut from the log. These boards may be subsequently straightened. This process is referred to as shape sawing.

Existing devices for shape sawing may have problems in certain situations. For example, if a log is too large, then a single arbor saw blade may not be sufficient to cut the log and a dual vertical arbor saw may be required. However, a smaller log may then be introduced to the shape sawing system and the dual vertical arbor saw may be wasteful or otherwise undesirable. Alternatively, the logs may not be oriented such that they can be appropriately sawed.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example and not by way of limitation in the figures of the accompanying drawings.

DETAILED DESCRIPTION

In the following detailed description, reference is made to the accompanying drawings which form a part hereof wherein like numerals designate like parts throughout, and in which is shown by way of illustration embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

Embodiments described herein are directed to a dual vertical arbor saw and infeed. The dual vertical arbor saw may have a saw box that is pivotable around, and laterally repositionable along, a generally horizontal axis of rotation. Thus, the saw box (and saws within) can be moved laterally while pivoting to follow the sweep of a log or cant feeding into the saws. The infeed may include one or more chipper units with positioning rolls. The positioning rolls may be coupled to a pair of levers that are joined at a common pivot point. The levers can be actuated to move the positioning rolls synchronously toward and away from a longitudinal center for accurate positioning of logs or cants feeding in to the saw.

Figure 1:
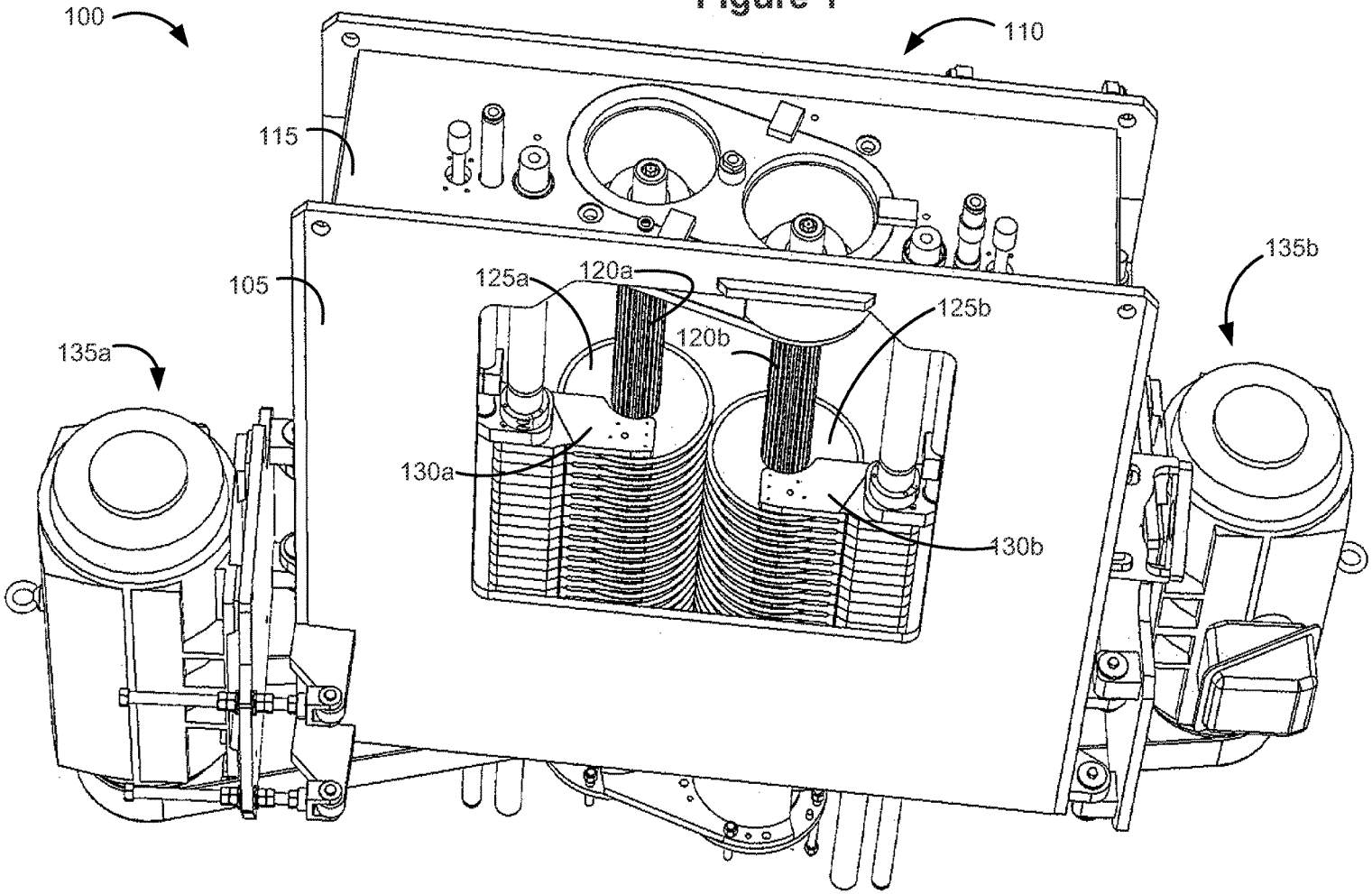
FIG. 1 depicts a perspective view of a simplified saw box, according to embodiments.

FIG. 1 depicts a simplified perspective view of a saw box 100 according to embodiments of the present disclosure. The saw box 100 may comprise a front side 105, a back side 110, and a top side 115. A longitudinal axis may be defined as an axis from the front side 105 of the saw box 100 to the back side 110 of the saw box. A horizontal axis may be defined as an axis perpendicular to the longitudinal axis and generally parallel to the top side 115 of the saw box 100. The saw box 100 may include two generally vertically oriented arbors 120*a*, 120*b*. A gang saw 125*a*, 125*b* may be mounted on each of the two vertical arbors 120*a*, 120*b*. The saw box 100 may further include a guide 130*a*, 130*b* for each of the two vertical arbors 120*a*, 120*b*. Finally, a drive 135*a*, 135*b* may be coupled with, and configured to rotate, each of the two vertical arbors 120*a*, 120*b*, thereby rotating the two gang saws 125*a*, 125*b*.

The arbors 120*a*, 120*b* and the gang saws 125*a*, 125*b*, may be both horizontally and longitudinally offset from one another as shown in FIG. 1. For example, as shown in FIG. 1 arbor 120*b* may be closer to the front side 105 of the saw box 100 than arbor 120*a*, while arbor 120*a* may be closer to the back side 110 of the saw box 100 than arbor 120*b*. In this arrangement, the gang saws 125*a*, 125*b* may be positioned such that the blades of the gang saws 125*a*, 125*b* slightly overlap along the longitudinal axis of the saw box 100, but are offset along the longitudinal axis so that they do not collide with one another. A log travelling longitudinally through the saw box 100 may therefore be thoroughly sawed by gang saws 125*a*, 125*b*.

It will be understood that in other embodiments the arbors may not be offset from one another in one or both of the horizontal and longitudinal directions. In other embodiments, arbor 120*a* may be closer to the front side 105 of the saw box 100 than arbor 120*b*. Additionally, arbors 120*a*, 120*b* may each be rotated by a plurality of drives, or a single drive. In some embodiments, the arbors may spin in directions opposite to one another, and in other embodiments the arbors may spin in directions identical to one another. In certain embodiments, the gang saws 125*a*, 125*b* may have the same or different diameters. In some embodiments, the diameter of the gang saws 125*a*, 125*b* may be large enough to cut logs with a diameter between 6" and 8". In other embodiments the gang saws 125*a*, 125*b* may have larger or smaller diameters.

In some embodiments, the top side 115 of the saw box 100 may be at least partially removable such that the interior of the saw box 100 is accessible without having to remove the saw box partially or completely from a sawing system For example, the top side 115 of the saw box 100 may have hinges, clasps, or some other form of fastening that allow the top side 115 to be removed from the saw box 100. A removable top side 115 may be desirable because it may make it easier for an individual to access or repair the interior of the saw box 100, or elements such as the arbors 120*a*, 120*b*, the gang saws 125*a*, 125*b*, or the guides 130, 130*b*.

Figure 2:
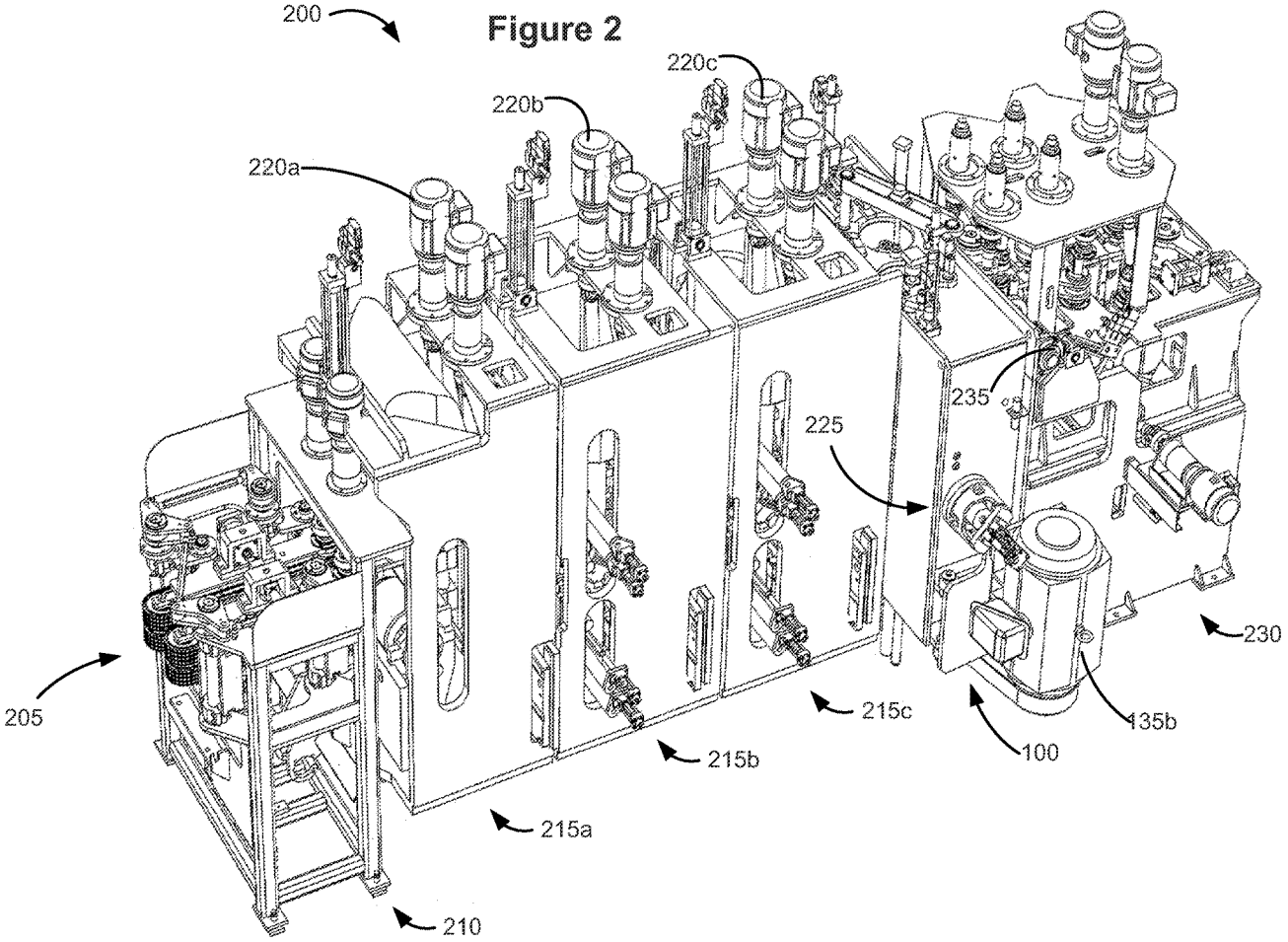
FIG. 2 depicts a perspective view of a log sawing apparatus, according to embodiments.

FIG. 2 depicts an embodiment of a sawing system 200 that may use the saw box 100 of FIG. 1. A log may be introduced to an infeed end 205 of the system 200 via an infeed unit 210. The log may be passed through a plurality of chipping units 215*a*, 215*b*, 215*c*. The chipping units 215*a-c* may each contain profiling chip heads. In some embodiments, all three of chipping units 215*a-c* may not be necessary. For example, if the log has a relatively small diameter, then a single chipping unit 215*a* may only be desired. Alternatively, more than three chipping units may be desirable. The chipping units 215*a-c* may each include a plurality of vertical rollers, at least one of which may be attached to a drive 220*a*, 220*b*, 220*c*. The vertical rollers and drives will be described in further detail below.

The log may then pass from the chipping units 215*a-c* to the saw box 100. As described with respect to FIG. 1, the saw box 100 may be coupled with one or more drives, such as drive 135*b*, that are configured to rotate one or more of the arbors within the saw box 100. The saw box 200 may further comprise a pivot assembly 225 coupled with the saw box 100 along the horizontal axis of the saw box 100. As will be described with further detail below, the saw box 100 may be tiltable around the pivot assembly 225, and the saw box 100 may be configured to move laterally along the pivot assembly 225.

After passing through the saw box 100, the leading end of the sawn log may enter an outfeed unit 230. The outfeed unit 230 and the saw box 100 may be coupled to a saw box rotate assembly 235 which is configured to rotate the saw box 100 around the horizontal axis.

Figure 3:
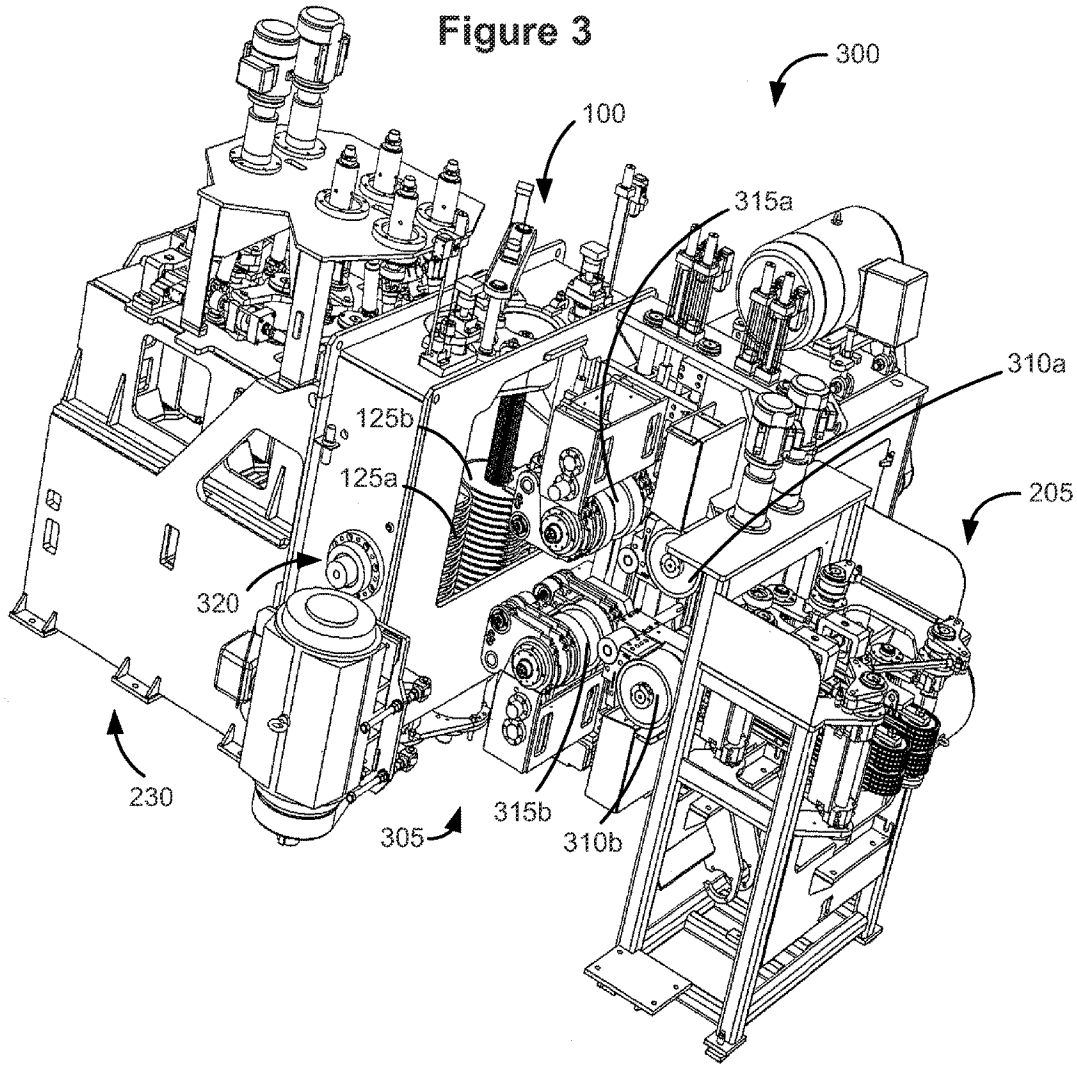
FIG. 3 depicts a perspective view of an alternative log sawing apparatus, according to embodiments.

FIG. 3 depicts an alternative embodiment of a sawing system 300. This system may comprise an infeed unit 205 and a single chipper unit 305. The chipper unit 305 may be identical to one of the chipper units 215*a-c* depicted in FIG. 2, or may have an alternative configuration, for example a configuration combining two or more of chipper units 215*a-c* or groups of chip heads into a single unit. In this embodiment, chipper unit 305 may include a first upper chip head 310*a*, a first lower chip head 310*b*, a second upper chip head 315*a*, and a second lower chip head 315*b*. Any one or more of the chip heads may be profiling chip heads. For example, the first upper and lower chip heads may be configured to produce a flat horizontal surface, and the second upper and lower chip heads may be profiling chip heads.

The log may pass through the chipper unit 305 into the saw box 100. The log then passes from the saw box 100 to an outfeed unit 230. FIG. 3 also depicts an pivot end 320 which may be coupled with the saw box 100 along the horizontal axis of the saw box. This saw box 100 may move laterally along the pivot end 320 responsive to movement of an actuator coupled with pivot assembly 225. Additionally, the saw box 100 may rotate around the pivot end 320 responsive to movement of the saw box rotate assembly 235.

Figure 4:
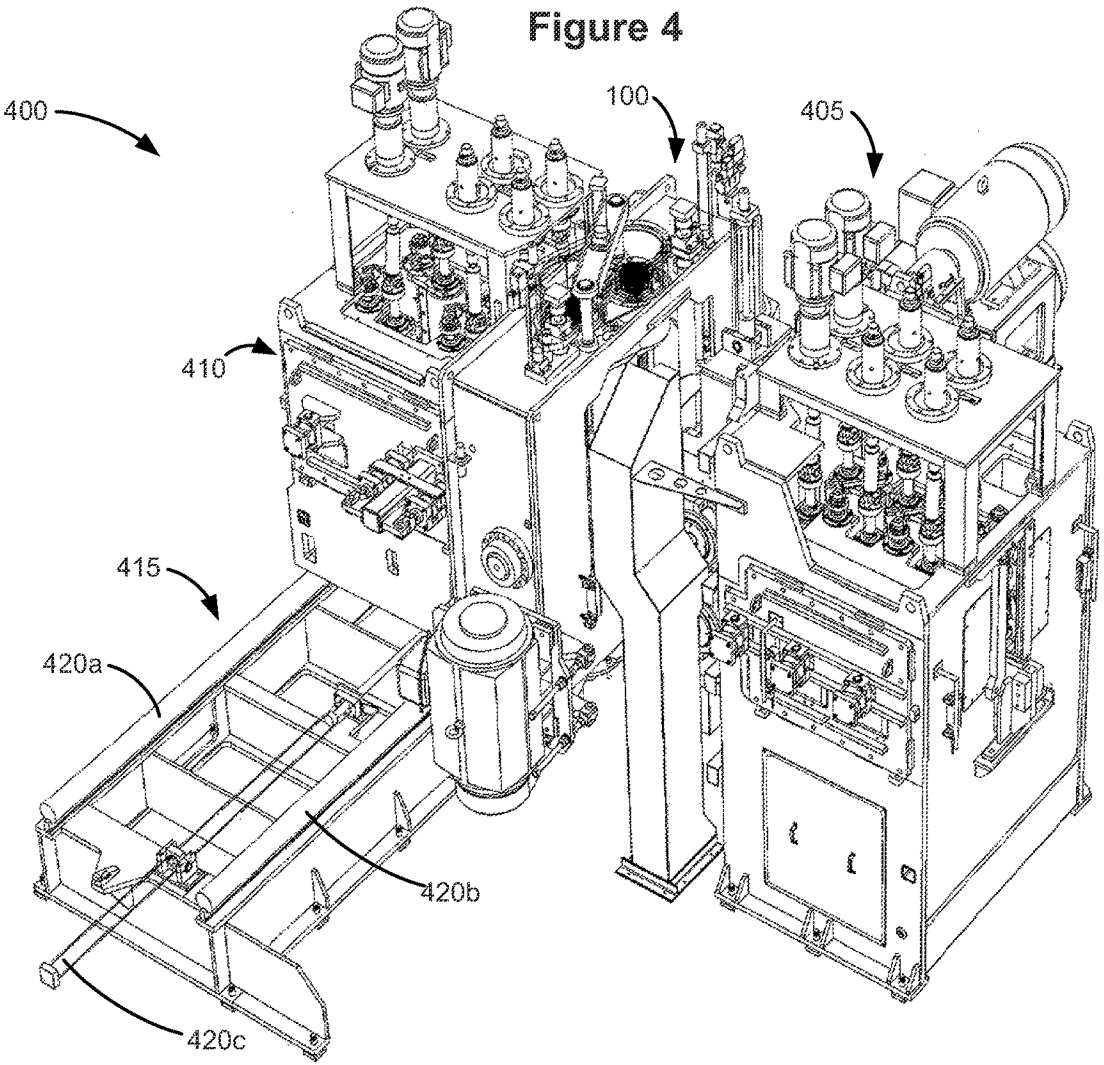
FIG. 4 depicts a perspective view of an alternative log sawing apparatus, according to embodiments.

FIG. 4 depicts another alternative embodiment of a sawing system 400. In this embodiment, the infeed unit and the chipper unit are combined into a single infeed unit 405. A log may be introduced to the infeed unit 405, and then pass from the infeed unit 405 to a saw box 100. From the saw box 100, the log may pass to the outfeed unit 410. In this embodiment, the outfeed unit 410 is laterally moveable along a rail system 415 comprising a plurality of rails 420*a*, 420*b*, 420*c*.

It will be understood that although different infeed units, for example infeed unit 405 and infeed unit 205, or different outfeed units such as outfeed unit 230 or outfeed unit 410 are described with respect to specific systems 200, 300, 400, different embodiments may have different combinations of these units. For example, an alternative system may include outfeed unit 410 coupled with infeed unit 405 and one or more of chipper units 215*a-c*, or chipper unit 305. One skilled in the art will recognize the different combinations possible with the different described units in FIGS. 2-4.

Figure 5:
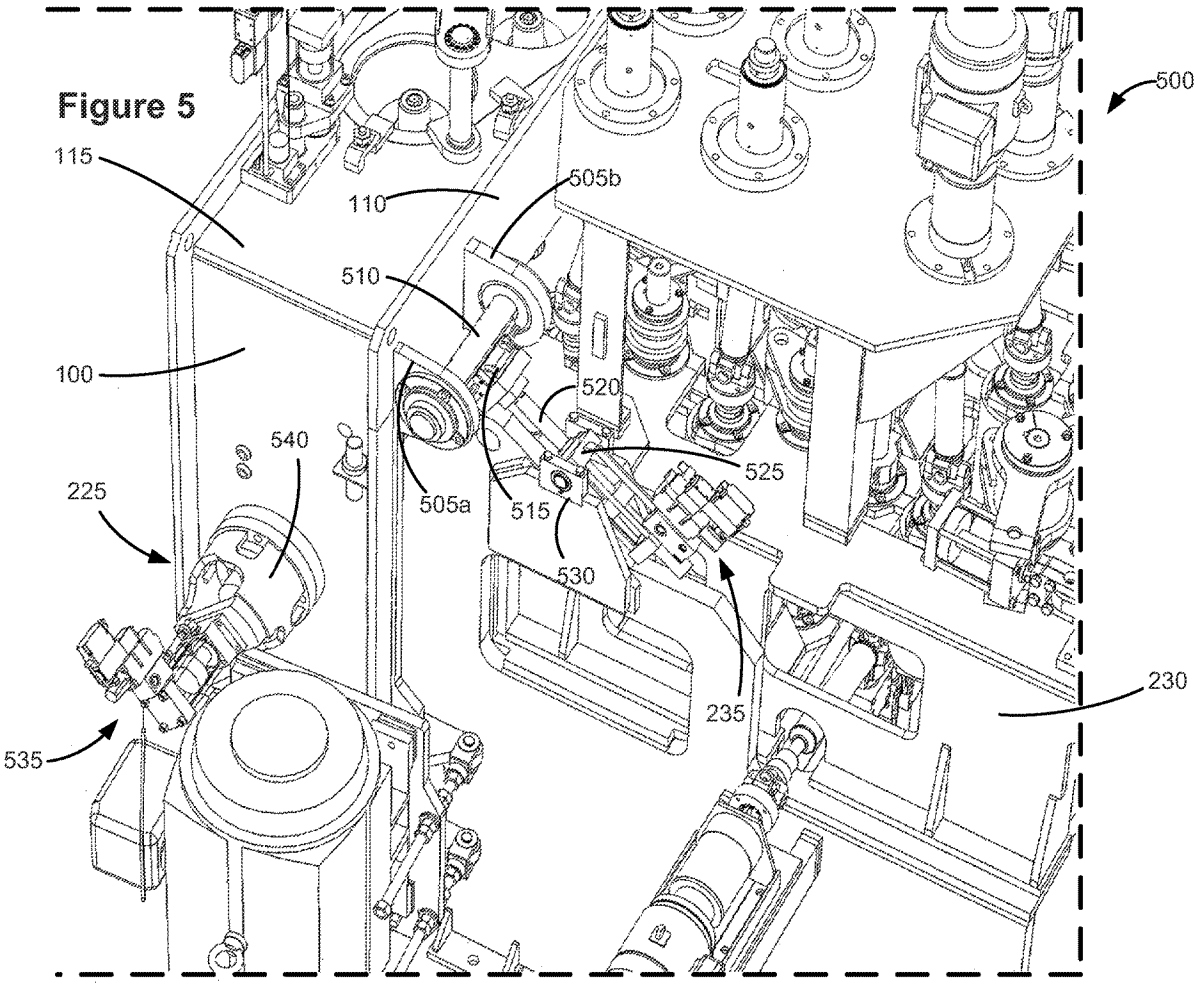
FIG. 5 depicts a close-up perspective view of a log sawing apparatus showing a saw box rotate assembly, according to embodiments.

FIG. 5 depicts a close up perspective view of a portion of a system 500 combining one or more of the outfeed units such as outfeed unit 230, according to embodiments of the disclosure. It will be recognized that the system 500 extends beyond the dashed lines shown in FIG. 5, and that although the discussion with respect to this embodiment includes outfeed unit 230, outfeed unit 410 could alternatively be used.

The system 500 may comprise an outfeed unit 230 and a saw box 100. The saw box 100 may comprise a back side 110 coupled with a plurality of bases 505*a*, 505*b* with a hinge 510 placed therebetween. The hinge 510 may be configured to couple with a carriage 515 of a saw box rotate assembly 235. Saw box rotate assembly 235 may include an actuator (e.g., a linear positioner). The carriage 515 of the saw box rotate assembly 235 may be coupled to the actuator. In the illustrated embodiment, the carriage 515 is coupled to an end of a rod 520 of an actuator which is configured to extend or contract rod 520 with respect to a base 525 of the saw box rotate assembly 235. The saw box rotate assembly 235 may be rotatably coupled with the outfeed unit 230 via one or more hinges 530. The pivot assembly 225 may comprise an actuator 535 coupled with a cylinder mount 540. The cylinder mount 540 may then be coupled with the saw box 100. Further details of the pivot assembly 225 are discussed below with respect to FIG. 7.

As shown in FIG. 5, when the rod 520 extends from the base 525 of the saw box rotate assembly 235, the carriage 515 may exert a force on the hinge 510. This force may cause the saw box 100 to rotate around the horizontal axis of the saw box 100, and the top side 115 of the saw box 100 may move away from the outfeed unit 230. By contrast, when the rod 520 contracts towards the base 525 of the saw box rotate assembly 235, the carriage 515 may exert a force on the hinge 510 that causes the saw box 100 to rotate such that the top side 115 of the saw box 100 moves closer to the outfeed unit 230.

It will be recognized that a different configuration of the hinge 510 and bases 505*a*, 505*b* is possible such that the hinge 510 is connected to the saw box 100 by only a single base, or more than 2 bases. Additionally, the saw box 100 may be connected to a plurality of saw box rotate assemblies configured to rotate the saw box 100.

Figure 6:
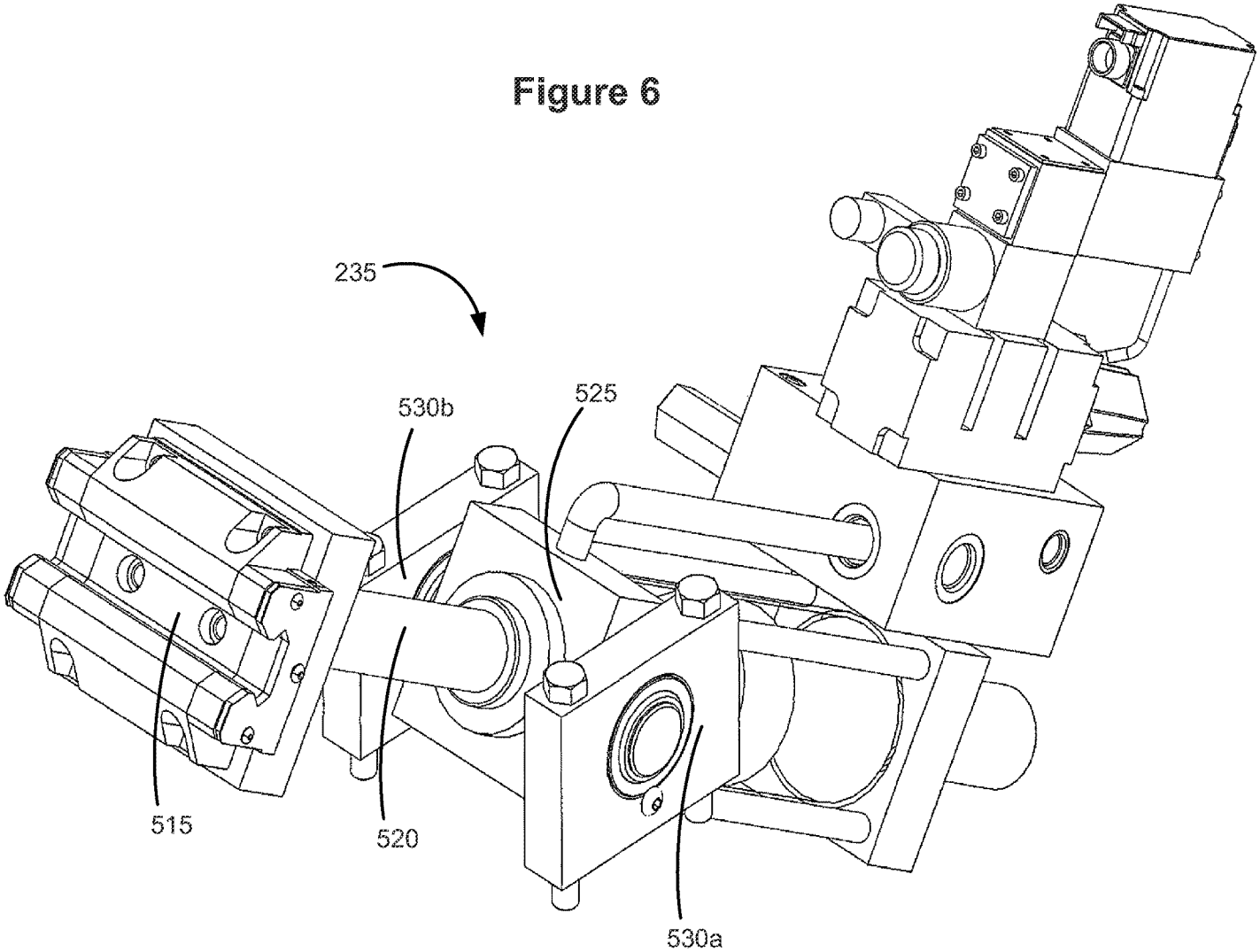
FIG. 6 depicts an alternative perspective view of a saw box rotate assembly, according to embodiments.

FIG. 6 depicts a perspective view of the saw box rotate assembly 235 including the carriage 515, the rod 520, the base 525 and two hinges 530*a*, 530*b* which may be used for coupling the saw box rotate assembly 235 to an outfeed unit 230 according to embodiments. It will be noted that the carriage 515 is configured such that it may slide along the hinge 510 if the saw box 100 moves laterally. In this manner, the saw box 100 may slide laterally and not be decoupled from the saw box rotate assembly 235.

Figure 7:
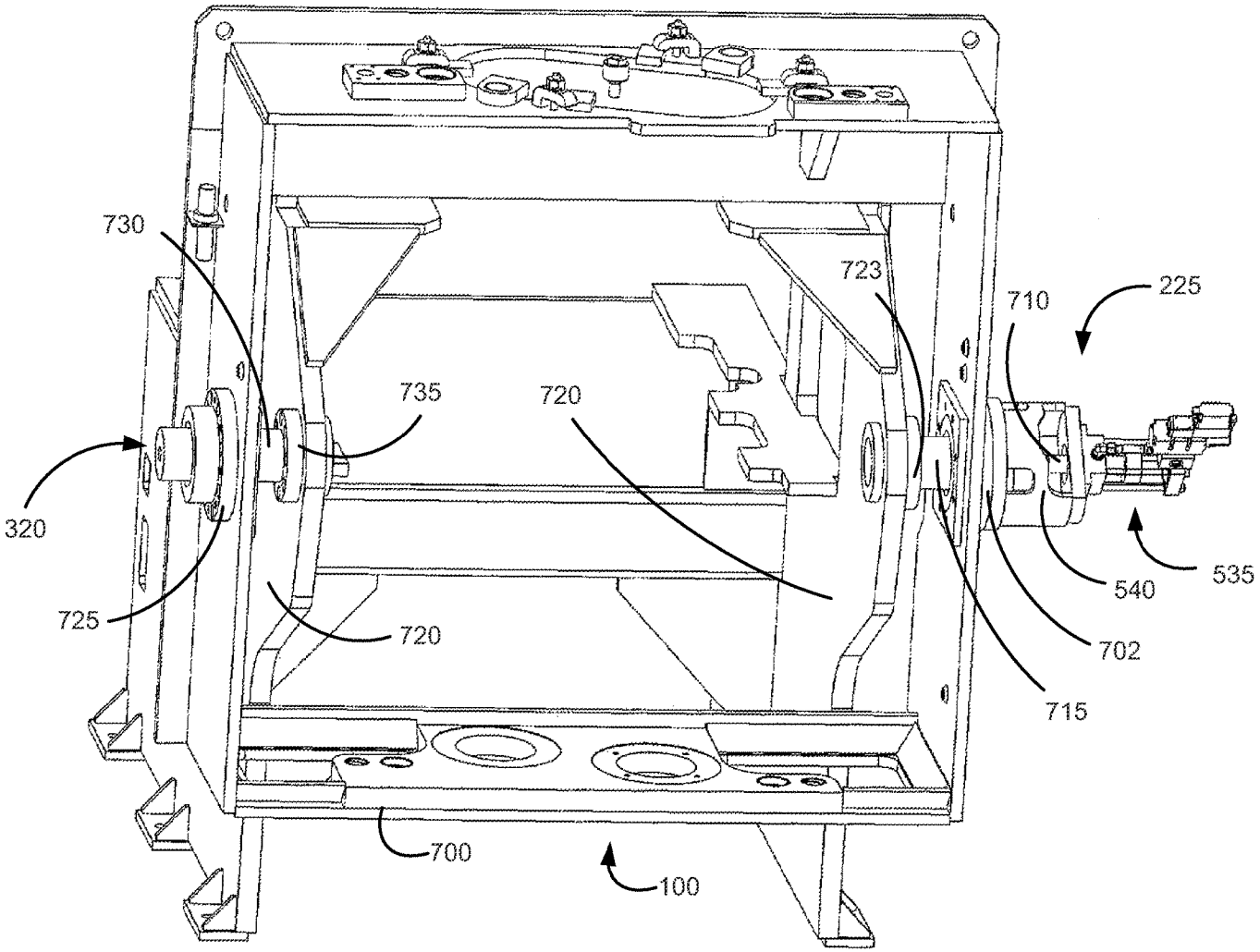
FIG. 7 depicts a cut-away view of a saw box, according to embodiments.

FIG. 7 depicts a view of a saw box 100 showing how lateral and rotational movement of the saw box 100 may be achieved according to embodiments. The saw box 100 may include a frame 700 which may be coupled with a pivot assembly 225. The pivot assembly 225 may include an actuator 535 and a cylinder mount 540. The cylinder mount 540 is shown as partially cut away in FIG. 7. The actuator 535 may be coupled with the cylinder mount 540, which may be coupled with the frame 700 of the saw box 100. In some embodiments, the cylinder mount 540 may be coupled with the frame 700 via a bushing 702. The actuator 535 may further include a rod 710 which extends from the actuator 535 into the cylinder mount 540.

The pivot assembly 225 may further comprise a pivot pin 715 which extends through the frame 700 of the saw box 100 and is coupled with the rod 710 of the actuator 535 inside of the cylinder mount 540. The pivot pin 715 may also be coupled with an internal support such as a portion of the frame 720 of an outfeed unit such as outfeed units 230 or 410 via a second bushing 723.

FIG. 7 further depicts a pivot end 320 which may be coupled with the frame 700 of the saw box 100 on an opposite side of the saw box 100 from the pivot assembly 225. The pivot end 320 may comprise a bushing 725 coupled with the frame 700 of the saw box 100. The bushing 725 may also be coupled with a second pivot pin 730 of the pivot end 320. The second pivot pin 730 may be further coupled with another portion of the frame 720 of an outfeed unit via bushing 735.

In some embodiments, the actuator 535 may create a force on the rod 710 which is coupled with the pivot pin 715. Because the pivot pin 715 may be coupled with the frame 720 of an outfeed unit, the force may cause the saw box 100 to move horizontally with respect to the outfeed unit. For example, if the actuator 535 extends the rod 710, the force of the rod 710 may cause the actuator to move further from the frame 720. Because the actuator may be coupled with, and inseparable from, the frame 700 of the saw box 100, the frame 700 may slide laterally along pivot pins 715 and 730 and move to the right as viewed in FIG. 7. By contrast, if the actuator 535 contracts the rod 710, the frame 700 of the saw box 100 may move to the left as viewed in FIG. 7. Additionally, because of bushings 725, 735, 723, and 702, the saw box 100 may be able to move rotationally with respect to the frame 720 of the outfeed unit, as described above with respect to FIGS. 5 and 6.

It will be recognized that in other embodiments, an actuator may also be coupled with the pivot end 320. Some embodiments may have multiple actuators. Additionally, the actuator may be coupled elsewhere on the frame 700 of the saw box 100, and still operable to create a force on pivot pin 715.

Figure 8:
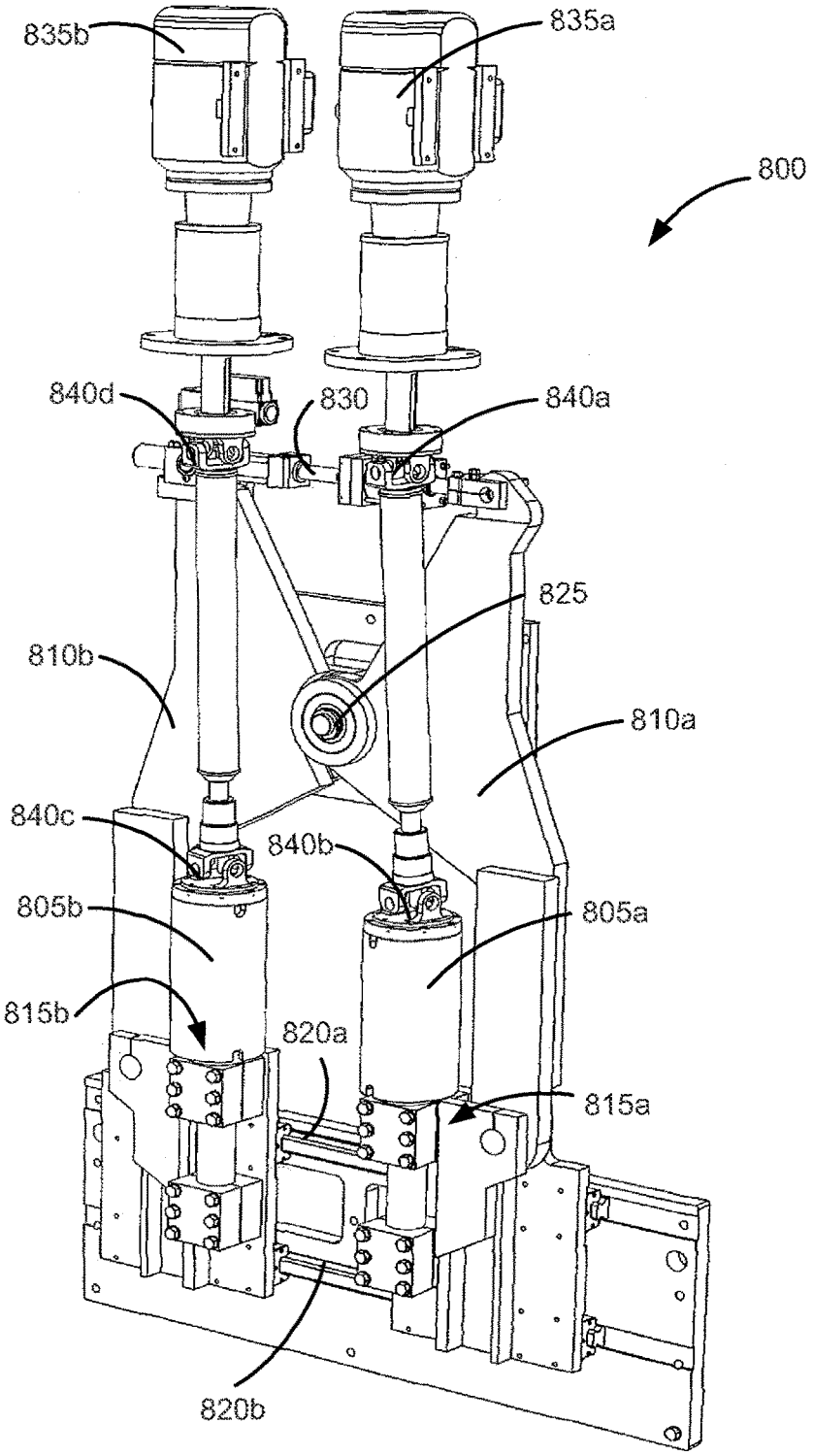
FIG. 8 depicts a vertical roller and drive assembly, according to embodiments.

FIG. 8 depicts an embodiment of a vertical roller and drive assembly 800 that may be present in one or more of chipper units 215*a-c*, as described above with respect to FIG. 2. The assembly 800 comprises a plurality of vertical rollers 805*a*, 805*b*. In this embodiment, there are only two vertical rollers 805*a*, 805*b*, though other embodiments may have more or less rollers. The rollers 805*a*, 805*b* are coupled with a first lever 810*a* and a second lever 815*b*. In one embodiment, the rollers 805*a*, 805*b* may be coupled with respective levers 810*a*, 810*b* via respective carriages 815*a*, 815*b* pivotably attached to respective levers 810*a*, 810*b* and configured to slide laterally along a plurality of guiderails 820*a*, 820*b*. Although two carriages 815*a*, 815*b* and two guiderails 820*a*, 820*b* are shown in the depicted embodiment, it will be appreciated that more or less carriages and/or guiderails may be used. The carriages may be movably coupled to the levers. For example, the carriages may be pivotably coupled to the levers by a pin or shaft.

The levers 810*a*, 810*b* may be coupled with one another via a pivot 825 defining a pivot axis. The levers 810*a*, 810*b* may also be coupled with one another via an actuator 830. In the depicted embodiment, when the actuator 830 expands, the levers 810*a*, 810*b* may pivot around the pivot axis 825. When the levers 810*a*, 810*b* pivot around the pivot axis 825, the carriages 815*a-d* may slide along the guiderails 820*a*, 820*b* and result in rollers 805*a*, 805*b* moving closer to one another. Similarly, when the actuator 830 contracts, the levers 810*a*, 810*b* may pivot around the pivot axis 825 in such a manner that the carriages 815*a-d* move horizontally along the guiderails 820*a*, 820*b* and the rollers move vertically further from one another.

It will be appreciated that in other embodiments, the placement of the actuator 830, the pivot 825 and the rollers 805*a*, 805*b* may be altered with respect to the lever 810*a*, 810*b*. For example, the levers 810*a*, 810*b* may cross one another at the pivot axis 825. Alternatively, the pivot axis 825 may be located at a top portion of the levers 810*a*, 810*b*, and the actuator 830 may be located in a middle portion of the levers 810*a*, 810*b*. Other embodiments may have different mechanical structures, as will be recognized by one of ordinary skill in the art. It will also be recognized that the actuator 830 may be hydraulic, electric, mechanical, or some other form of actuator as will be recognized in the art.

The rollers 805*a*, 805*b* may be passive, or they may be powered. If they are powered, they may be coupled with one or more drives 835*a*, 835*b* via one or more universal joints 840*a-d*. In the depicted embodiment, roller 805*a* is coupled with drive 835*a* by a shaft member with two universal joints 840*a*, 840*b*. Additionally, roller 805*b* is coupled with drive 835*b* via another shaft member with universal joints 840*c*, 840*d*. In other embodiments, other types of movable joints known in the art may be used instead of universal joints. The universal joints 840*a-d* may be desirable because they may allow the rollers 805*a*, 805*b* to move with the carriages along the guiderails 820*a*, 820*b* without becoming decoupled from drives 835*a*, 835*b* or altering the vertical orientation of the rollers 805*a*, 805*b*.

One of skill in the art will recognize that the described embodiments offer several advantages. For example, the use of one or more vertical roller and drive assemblies 800 in one or more infeed units 215*a-c* may allow an operator of a sawing system 200 to precisely center and orient a log being sawed, even if the log has a different thickness than the log before it. Additionally, the use of a saw box 100 that is able to move both laterally and rotationally may allow for the precise sawing of logs of different widths or orientations without having to spend large amounts of down time on re-positioning the elements of the sawing apparatus 200. In addition, the ability to move the saw box 100 laterally means that if the saws need to be moved laterally, the saw box 100 can move to accommodate the log rather than having to move an infeed of a sawing system. These benefits will offer savings in terms of time and operator effort.

Although certain embodiments have been illustrated and described herein for purposes of description, this application is intended to cover any adaptations or variations of the embodiments discussed herein. Therefore, it is manifestly intended that embodiments described herein be limited only by the claims.

Where the disclosure recites "a" or "a first" element or the equivalent thereof, such disclosure includes one or more such elements, neither requiring nor excluding two or more such elements. Further, ordinal indicators (e.g., first, second or third) for identified elements are used to distinguish between the elements, and do not indicate or imply a required or limited number of such elements, nor do they indicate a particular position or order of such elements unless otherwise specifically stated.

What is claimed is:

1. An infeed unit for a wood processing apparatus, the infeed comprising:

a first positioning roll and a second positioning roll disposed on opposite first and second sides, respectively, of a longitudinal center of a feed path;

a first lever coupled with the first positioning roll;

a second lever coupled with the second positioning roll, wherein the first and second levers are pivotably coupled together and rotatable around a common pivot axis; and an actuator coupled with the first lever and second lever, the actuator operable to rotate the first and second levers around the common pivot axis to thereby laterally reposition the first positioning roll and the second positioning roll relative to the longitudinal center of the feed path.

2. The infeed unit of claim 1, further comprising:

a lateral support;

a first carriage unit coupled with the first positioning roll and slidably coupled with the lateral support; and a second carriage unit coupled with the second positioning roll and slidably coupled with the lateral support;

wherein the first carriage unit and the second carriage unit are moveable along the lateral support.

3. The infeed unit of claim 2, further comprising a first drive coupled to the first positioning roll by a first shaft with one or more moveable joints, wherein the first drive is operable to rotate the first positioning roll while the first carriage member is moved along the lateral support.

4. The infeed unit of claim 3, wherein said one or more movable joints includes a universal joint.

5. The infeed unit of claim 2, wherein the first carriage unit is pivotably coupled to the first lever and the second carriage unit is pivotably coupled to the second lever.

6. The infeed unit of claim 2, wherein the carriage units are disposed at least partially below the longitudinal center of the feed path, and the common pivot axis and the actuator are disposed above the feed path.

7. The infeed unit of claim 1, further comprising a pivot member defining the common pivot axis, wherein the first lever and the second lever are coupled to one another via the pivot member.

8. The infeed unit of claim 7, wherein the first lever comprises a first end coupled with the actuator, a second end opposite the first end and coupled with the first positioning roll, and a middle portion between the first end and the second end, and wherein the middle portion is coupled with the pivot member.

9. The infeed of claim 7, wherein the common pivot axis extends substantially parallel to the feed path and the pivot member is disposed through the first lever and the second lever.

10. The infeed unit of claim 1 further comprising a chip head.

11. The infeed unit of claim 10, wherein the chip head is a profiling chip head.

12. The infeed of claim 1, wherein the first and second levers have first and second ends, the first positioning roll is coupled to the first end of the first lever, and the second positioning roll is coupled to the first end of the second lever.

13. The infeed of claim 1, wherein a first end of the actuator is coupled to the first lever, and a second end of the actuator is coupled to the second lever, and the actuator is positioned above or below the pivot axis.

14. A method of providing an infeed for a wood processing apparatus, the method comprising:

coupling a first lever with a first positioning roll;

coupling a second lever with a second positioning roll, wherein the first and second positioning rolls are disposed on opposite first and second sides, respectively, of a longitudinal center of a feed path;

pivotably coupling the first and second levers together, such that the first and second levers are rotatable around a common pivot axis; and coupling an actuator with the first lever and the second lever, wherein the actuator is operable to rotate the levers around the common pivot axis to thereby laterally reposition the first positioning roll and the second positioning roll relative to the longitudinal center of the feed path.

15. The method of claim 14, further including:

coupling a first carriage unit with the first positioning roll;

coupling a second carriage unit with the second positioning roll;

slidably coupling the first carriage unit and the second carriage unit with a lateral support, such that the first and second carriage units are moveable along the lateral support.

16. The method of claim 15, further comprising:

coupling a first shaft with the first positioning roll, wherein the first shaft has one or more moveable joints; and coupling a first drive with the first shaft, such that the first drive is operable to rotate the first positioning roll while the first carriage unit is moved along the lateral support.

17. The method of claim 16, wherein said one or more movable joints includes a universal joint.

18. The method of claim 15, wherein coupling the first carriage unit with the first positioning roll includes pivotably coupling the first carriage unit with the first lever.

19. The method of claim 15, wherein the first positioning roll is rotatably mounted to an upper portion of the first carriage unit, the first carriage unit is disposed at least partially below the feed path, and the common pivot axis and the actuator are disposed above the feed path.

20. The method of claim 14, wherein pivotably coupling the first and second levers together includes coupling a pivot member with the first lever and the second lever, and wherein the pivot member defines the common pivot axis.

21. The method of claim 20, wherein the first lever comprises a first end coupled with the actuator, a second end opposite the first end and coupled with the first positioning roll, and a middle portion positioned on the first lever between the first end and the second end, and wherein the middle portion is coupled with the pivot member.

22. The method of claim 20, wherein the common pivot axis extends substantially parallel to the feed path and the pivot member is disposed through the first lever and the second lever.

23. The method of claim 14, further comprising providing a chip head proximal to the first and second positioning rolls.

24. The method of claim 23, wherein the chip head is a profiling chip head.

25. The method of claim 14, wherein the first and second levers have opposite first and second ends, the first positioning roll is coupled to the first end of the first lever, and the second positioning roll is coupled to the first end of the second lever.

26. The method of claim 14, wherein a first end of the actuator is coupled to the first lever, and a second end of the actuator is coupled to the second lever, and the actuator is disposed above or below the common pivot axis.

* * * * *